United States Patent [19]

Tsuda et al.

[11] 4,357,393

[45] Nov. 2, 1982

[54] SINTERED POROUS METAL PLATE AND ITS PRODUCTION

[75] Inventors: Masatoshi Tsuda, Kyoto; Takeshi Kobayashi, Suita; Katsumi Kaitani, Yao, all of Japan

[73] Assignee: Katuragi Sangyo Co., Ltd., Osaka, Japan

[21] Appl. No.: 138,332

[22] Filed: Apr. 8, 1980

[30] Foreign Application Priority Data

Apr. 10, 1979 [JP] Japan ..... 54-43219

[51] Int. Cl.[3] ..... B22F 7/04; B22F 7/08; B32B 5/18

[52] U.S. Cl. ..... 428/547; 181/294; 264/27; 428/550; 428/553

[58] Field of Search ..... 428/547, 550, 553; 252/62; 181/294

[56] References Cited

U.S. PATENT DOCUMENTS

| | | | |
|---|---|---|---|
| 2,267,918 | 12/1941 | Hildabolt | 428/547 |
| 3,186,871 | 6/1965 | Donohue | 428/550 |
| 4,283,465 | 8/1981 | Morimoto et al. | 181/294 X |

OTHER PUBLICATIONS

Metcalfe, A. G. et al, "Fiber Metallurgy" Metal Progress, Mar. 1955, pp. 81–84.

*Primary Examiner*—Helen M. McCarthy
*Attorney, Agent, or Firm*—Armstrong, Nikaido, Marmelstein & Kubovcik

[57] ABSTRACT

The present invention relates to a sintered porous metal plate which comprises metal particles directly and integrally bonded together by sintering under pressure, said plate being of a porous structure and having a density gradient in the direction of thickness. The present invention is also directed to a method of making such a sintered porous plate.

4 Claims, 5 Drawing Figures

SINTERED POROUS METAL PLATE AND ITS PRODUCTION

This invention relates to a sintered porous metal plate or sheet (hereinafter referred generally to "plate") and its production.

More particularly this invention relates to a sintered porous metal plate which comprises metal particles directly and integrally bonded together by sintering, said plate being of porous structure and having a density gradient in the direction of thickness. This invention also relates to a method of producing such sintered porous plate.

It has been proposed to produce a porous metal plate or sheet by heating metal particles with a binder under pressure. Since it is essential to use a binder in such known process the metal particles are not directly bonded together so that the resulting structure is poor in the strength. Further the total pore volume in the plate structure is small due to the presence of the binder so that the air-permeability and porosity are poor. More importantly, since the porosity is substantially uniform (i.e. there is no density gradient) throughout the plate structure, the sound absorption characteristics of the plate are not satisfactory.

Therefore, the principal object of this invention is to provide a sintered porous metal plate high in the strength and rigidity.

Another object of this invention is to provide a sintered porous metal plate having excellent sound and vibration absorption characteristics.

Other objects of this invention will become apparent from the following detailed explanation.

Briefly, the sintered porous metal plate of this invention comprises metal particles directly and integrally bonded together due to sintering, said plate being of porous structure and having a density gradient in the direction of thickness.

Such porous metal plate may be produced by various methods. According to one preferred embodiment of this invention, metal particles are charged into a mold comprising a pair of refractory side walls, refractory bottom wall and electrodes. The metal material in the mold is pressed by a refractory press until the metal mass attains to have a predetermined initial electric resistance value. Then an electric current is passed to the electrodes while controlling the current to uniformly heat the material. Then the whole metal material is heated up to its sintering temperature to effect the sintering. In order to obtain a density (porosity) gradient in the direction of thickness of the resulting sintered porous metal plate, the metal particles are charged in the mold in a plurality of layers respectively different in metal particle size. Alternatively or in addition thereto, temperature difference is created in layer-wise in the direction of thickness of the metal material in the mold.

The sintered porous metal plate or sheet of this invention, as compared with known ones, has various distinctive features such as (1) there is used no binder material, (2) the metal particles themselves are directly and strongly sintered-bonded together, (3) the plate has a density (porosity) gradient in layer-wise in the direction of thickness, such as coarse layer-dense layer-coarse layer structure, dense layer-coarse layer-dense layer structure, coarse layer-dense layer structure, etc. Due to this novel structural features the sintered porous plate or sheet of this invention has various advantages to be explained hereinlater.

In the practice of this invention any suitable metal material whose particles can be directly bonded together by pressing and sintering. Examples of such metal material include ferrous metal materials, aluminum type metal materials, titanium type metal materials, etc. However it is preferable to use abatements or chips produced as waste material in working, machining or cutting of metal such as aluminum alloy or cast iron. The particle size of such metal material may vary over a wide range such as 30-6 mesh or larger.

According to this invention the metal particles are shaped into a plate by pressing and sintering in a mold and in the absence of a binder, creating a layer-wise density gradient in the direction of thickness. The thickness of the resulting porous metal sheet may vary over a wide range depending upon the particular use, such as 5 mm to 30 mm. Generally, however, the thickness is 10–20 mm. The porosity may also vary over a wide range, but generally it is preferable that the sintered porous plate or sheet has a porosity of about 40–60%, more preferably about 50% as a whole.

The plate or sheet of this invention is rigid, strong and high in porosity since the metal particles themselves are directly bonded together under pressing and sintering without the use of a binder and with pores between the adjacent particles. Further, since there is a layer-wise density gradient in the direction of thickness the plate or sheet has excellent acoustic absorption and vibration absorption characteristics. The excellent acoustic or sound absorption property is the most important feature of the plate or sheet of this invention. Thus, the porous plate (or sheet) of this invention has the sound absorption characteristics of conventional porous material (high pitch or high frequency sound can be effectively absorbed but the absorption of low pitch or low frequency sound or vibration is almost impossible) because it has a porous structure, but also and more importantly the plate of this invention has the sound absorption characteristics of the so-called single resonator type sound absorption mechanism (low pitch or low frequency sound can be effectively absorbed) because the plate has a multi-layer structure with a density or porosity gradient. Therefore excellent sound or vibration absorption effect can be attained even with a single and relatively thin plate or sheet of the present invention.

The invention will be explained in more details as follows by referring partly to the accompanying drawings wherein.

Figure 1:
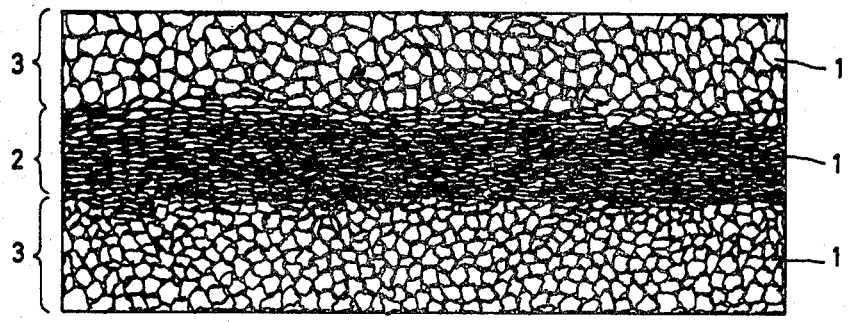
FIG. 1 is a schematic cross-section of a sintered porous metal plate embodying this invention.
Figure 2:
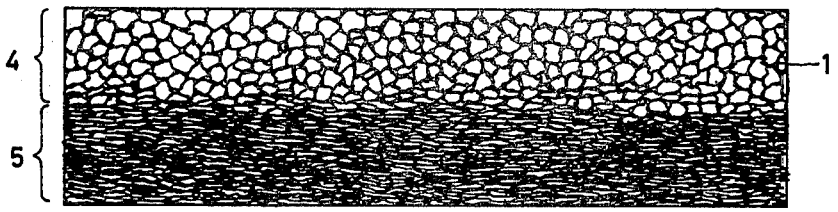
FIG. 2 is a schematic cross-section of another sintered porous metal plate embodying this invention.

Referring now to FIG. 1 the sintered porous metal plate is made of metal particles 1 which are mutually directly bonded together to form a unitary or integral structure. Between the adjacent metal particles are small pores so that, as a whole, the plate has a porous (air-permeable) structure. Further this plate has three layers i.e. two outer layers 3,3 with relatively coarse structure and one intermediate layer 2 with relatively dense structure. The multi-layer structure with different densities (or porosity) may take various other arrangement such as dense-coarse-dense layers, coarse-dense-coarse-dense layers, coarse-dense layers, etc. depending upon the particular desired use of the plate. Thus, for example, FIG. 2 shows a structure of two layers i.e. coarse layer 4 and dense layer 5. In any case, the plate itself has a porous and integral or unitary rigid structure and is distinguished from a construction wherein separate coarse layer and dense layer are bonded together by means of a binder.

In producing the sintered porous metal plate (or sheet) according to this invention, there is provided a refractory mold having a pair of side walls, bottom wall and electrodes. A predetermined amount of a metal particle material is charged in the mold. A refractory press is provided so as to press the metal material within the mold. While pressing or repeating pressing and press-stopping, the metal material in the mold is subjected to resistance-heating until mutual sintering-bonding of the metal particles is completed by passing electric current to the electrodes arranged at both ends of the mold. In this case it is important to take a proper measure to heat the whole charge as uniformly as possible. Generally, for this purpose, the metal material in the mold is first pressed, while controlling the pressure (e.g. 1–15 kg/cm$^2$), until the initial electric resistance value of the whole metal material comes within a predetermined range (e.g. $2\times10^{-2}\Omega$—$1\times10^{-1}\Omega$). Then the metal material is heated, while controlling the electric current to be passed to the electrodes, until the whole metal material comes up approximately to the transformation temperature. Then the metal material is further heated up to the sintering temperature (high enough but not to cause melting of the metal particles) and the current supply is stopped and the sintering is effected. This heating may be effected while pressing the material, or pressing may be applied after the material has come up to the sintering temperature.

The transformation temperature and sintering temperature of course vary depending upon the particular metal material used. For example, in case of cast iron (e.g. FC-25), the transformation temperature is about 730° C. and the sintering temperature is about 1000° C. In case of aluminum alloy (Si content 27%) the transformation temperature is about 560° C. and the sintering temperature is about 600° C. The thickness of the plate may be controlled by the amount of the metal material to be charged and also by controlling the pressure to be applied before or immediately after the material attains the sintering temperature.

In the above process, it is important to heat the whole or particular layer of the material as uniformly as possible. For this purpose, for example, the electrodes arranged at both ends of the mold are divided into individual plural pairs so that depending upon the difference in electric resistance of the materials between the respective pairs of electrodes the electric current to be passed to the individual electrodes is individually controlled so that the whole material may be uniformly heated.

Figure 3:
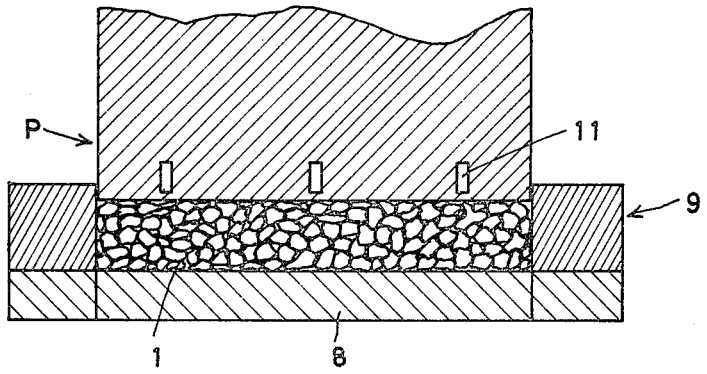
FIG. 3 is a schematic cross-section of an apparatus suitable for the production of a sintered porous metal plate of this invention.
Figure 4:
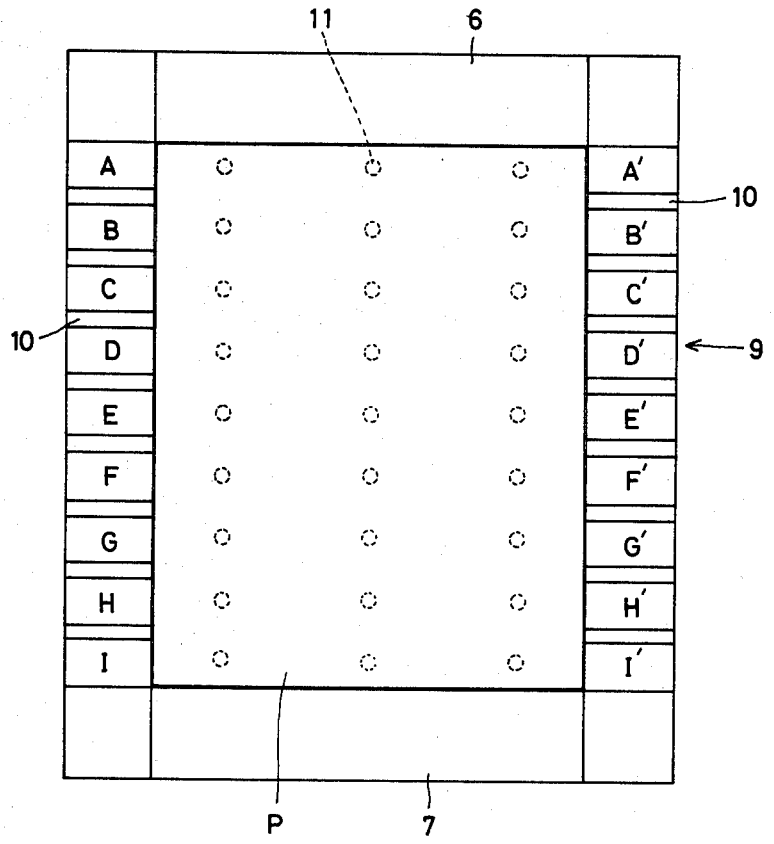
FIG. 4 is a plan view of the apparatus shown in FIG. 3.

An example of such apparatus is shown in FIGS. 3 and 4. As shown, the mold is constructed from refractory (nonconductor) block side walls 6,7, refractory block bottom wall 8 and electrodes 9. Metal particles 1 in a predetermined amount are charged into this mold. Indicated with P is a refractory press adapted to press the metal material in the mold. The electrode assembly 9 comprises plural pairs of counter-electrodes A–A', B–B', C–C', etc. with a refractory material (nonconductor) 10 between the adjacent electrodes as shown in FIG. 4. Thermocouples 11 (thermometers) are embedded in the press P and/or bottom wall 8 to measure the temperatures of the material between the respective pairs of electrodes. Depending upon the temperatures so measured, the voltage-current between the electrodes of each pair is controlled so that the whole metal material in the mold is heated as uniformly as possible.

As mentioned before the important feature of the porous metal plate or sheet of this invention is in that, while it has a structure of an integral sintered body, there is a layer-wise density gradient in the direction of thickness. This density gradient may be attained, for example, (1) by increasing (or lowering) the temperature of the surface layer portion and/or bottom layer portion as compared with the other layer portion, or (2) by layer-wise varying the metal particle size in charging the metal particles in the mold. In case of (1), for example, there is provided no heating means for the press P and bottom wall 8 of the apparatus shown in FIG. 3. Therefore, when the material in the mold is heated the heat is absorbed from the surface layer portion and the bottom layer portion respectively by the press and bottom wall so that the temperature of these layer portions is decreased with a result that the degree of softening and deformation of the particles in these portions is less and therefore relatively coarse structure is formed therein. However at the inner layer portion no such temperature decrease occurs so that the degree of softening and deformation of the metal particles is large with a result that a relatively dense structure is formed therein. In other words, there is formed a structure of coarse-dense-coarse three layers. This effect is enhanced when a cooling means (not shown) is associated with the press or bottom wall. On the contrary, if a heating means is provided in the bottom wall 8 so that the bottom layer portion of the metal material is heated to the same extent as in the inner layer portion, only the surface layer would become coarse so that there would be obtained a structure of two layers, i.e. coarse layer and dense layer. It is also possible provide a heating means in both of the press P and bottom wall 8 so that the surface layer portion and bottom layer portion are heated at a temperature higher than the inner layer portion there would be obtained a plate with a structure of three layers i.e. dense-coarse-dense structure. In taking the above mentioned measure (2), for example, a metal particle material with large metal particle size (e.g. 10–6 mesh) is first charged into the mold in the form of a layer and then a metal particle material with small metal particle size (e.g. 20–30 mesh) is charged in the same mold as a middle layer above the first layer and finally a metal particle material with large metal particle size (e.g. 10–6 mesh) is charged as the uppermost layer. The whole is then subjected to pressing and sintering as explained above to obtain a sintered porous metal plate with a structure having three layers i.e. coarse structure bottom layer, dense structure middle layer and coarse structure upper layer. If desired the above mentioned measures (1) and (2) may be properly combined. However, in any case, it is necessary that the degree or extent of heating and pressing is such that the porosity is maintained and the substantial melting of the metal particles is prevented so as to form an integrally bonded rigid and porous structure. The particular conditions would vary depending upon the particular metal, desired thickness of the plate (usually 5–30 mm., preferably 10–20 mm), desired degree of porosity, etc., but can be easily determined by routine pre-testing.

The shape of the plate or sheet of this invention may be varied (such as wavy shape) by properly modifying the shape of the mold and press.

The sintered porous metal plate or sheet of this invention has excellent sound absorbing and vibration absorbing properties and therefore is useful for those applications (such as heat exchanger, filter, sound absorbing material, vibration absorbing material) where such properties are required.

The invention will be further explained with reference to the following Examples which are given for illustration and not for limitation of the scope of the invention.

EXAMPLE 1

Figure 5:
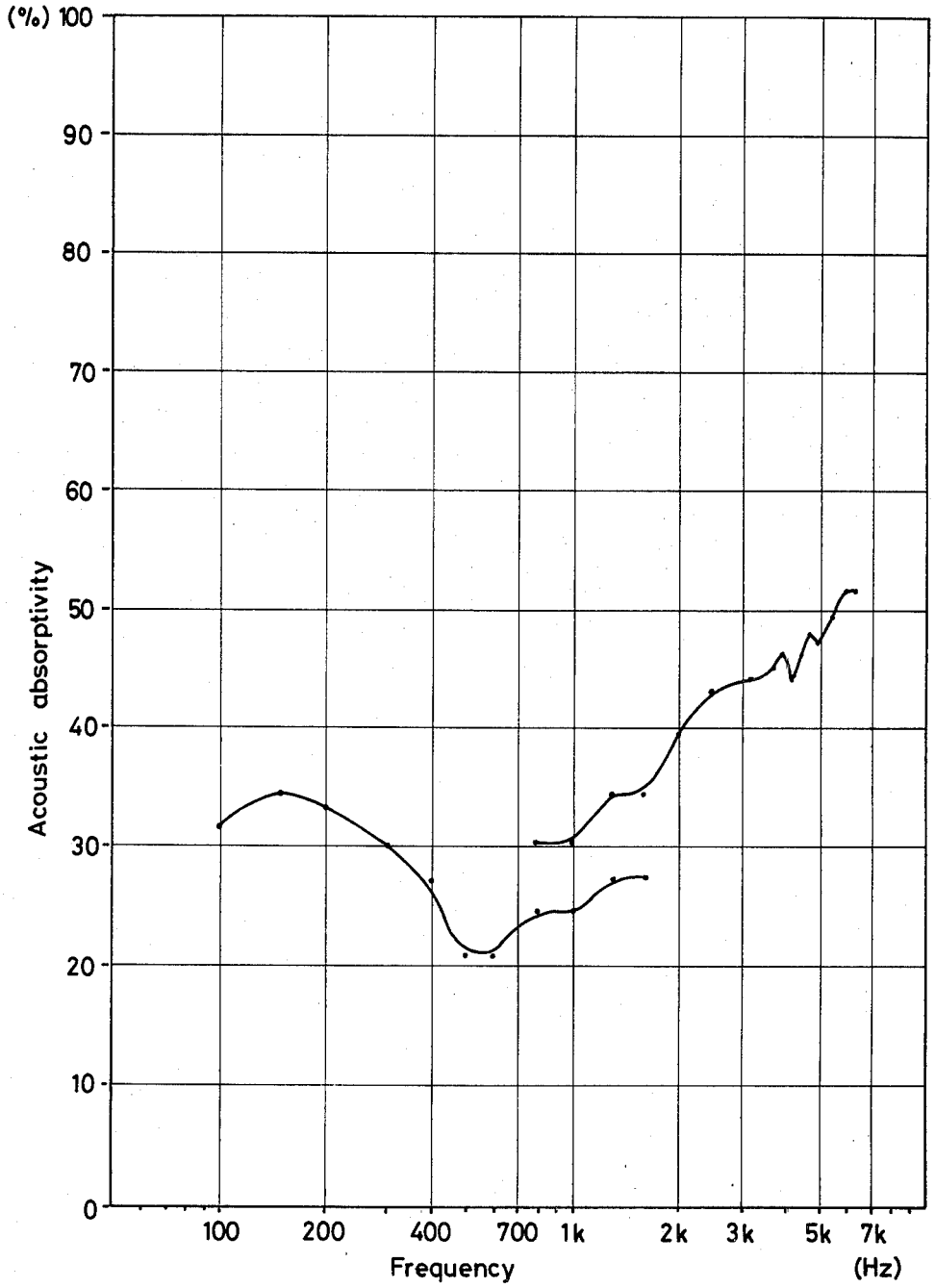
FIG. 5 is a graph showing sound absorption characteristics of a sintered porous metal plate of this invention.

An apparatus as shown in FIGS. 3 and 4 was employed. The interia area of the mold was 4×20 cm. and the depth was 5 cm. In this mold was charged 3 kg. of cutting chips (abatements) (particle size 6–10 mesh) of cast iron (FC-25) containing about 3.5% total carbon, about 2.5% silicon and about 0.5% manganese. Then a pressure was applied thereto by a press (10 kg/cm$^2$) until the initial resistance of the charged material comes within the range of from $2\times10^{-2}$ to $1\times10^{-1}\Omega$. Then, while measuring the temperatures by the thermocouples 11, an electric current passage to individual electrode pairs (in this case 9 pairs of electrodes 9) was increased (1–3200 A) until the whole metal material attains a constant level of temperature i.e. about 727° C. (transformation point) in 3 minutes. Then, while stopping the pressing, the temperature of the whole material was further heated up to 1050° C. in 4 minutes, whereupon the current passage was discontinued and the metal material was pressed (30 kg/cm$^2$) by the press P to complete sintering. There was provided no heating or cooling means for the press P and bottom block 8. The sintered porous plate (200×400×10 mm) thus obtained had a structure of coarse-dense-coarse layers as shown in FIG. 1 and its traverse bending strength (cross-breaking strength) was 0.45 kg/mm$^2$. The sound absorbing properties of this plate were as shown in FIG. 5. Each of the coarse layers had a thickness of about 3 mm. and a porosity of about 50%, while the dense or middle layer had a thickness of about 4 mm. and a porosity of about 40%.

EXAMPLE 2

The procedure of Example 1 was repeated except that an electric heating element (not shown) was embedded in each of the press P and bottom block 8 so that the metal material in directly contact with the surface of each of the press P and bottom block 8 was heated to 1100° C. at the time of sintering. The resulting porous plate (200×400×10 mm.) had a structure of three layers i.e. two dense layers with a coarse layer therebetween. The traverse bending strength of this plate was 7.88 kg/mm$^2$.

EXAMPLE 3

In the same mold as used in Example 1 there was charged 1.5 kg of cutting chips (6–10 mesh) of aluminum alloy (Si content 27%). The material was pressed (1–15 kg/cm$^2$) by the press P so that the initial resistance of the charged material comes within the range from $2\times10^{-2}$ to $1\times10^{-1}\Omega$. Then an electric current (1–3200 A) was passed to the electrodes for 2 minutes to heat the material until the whole attains a constant level of temperature i.e. about 564° C. (transformation point). Then, while effecting pressing (1–15 kg/cm$^2$) and press-releasing to obtain a thickness of 10 mm. of the metal material mass, the temperature was increased up to 600° C. in 3 minutes, whereupon the current passage was discontinued. There was provided no heating or cooling means for the press P and bottom block 8. The resulting sintered porous metal plate (200×400×10 mm.) had an integral rigid structure of three layers i.e. coarse-dense-coarse layers.

EXAMPLE 4

The procedure of Example 1 was repeated except that the cast iron cutting chips were charged in three layers (each 1 kg.) i.e. first layer with particle size of 6–10 mesh, middle layer with particle size of 10–20 mesh and last or upper layer with 6–10 mesh. Thus there was obtained a sintered porous metal plate (200×400×10 mm.) having a structure consisting of three layers i.e. coarse-dense-coarse layers.

The term "sintered" or "sintering" as used herein means that the metal material particles are heated up to such high temperature at which the particles are not completely melted but the particles are partly (particularly metallic component) melted while partly (particularly non-metallic inorganic compound component e.g. carbide) maintaining solid phase as dispersed in the molten metal phase.

What we claim is:

1. A sound absorbing or vibration absorbing sintered porous metal plate which comprises metal particles directly and integrally bonded together due to sintering and pressing without the use of a binder material, said plate being of porous structure and having a continuous density gradient in the direction of thickness and a multi-layer structure comprising two coarse layers with a dense layer therebetween.

2. A sound absorbing or vibration absorbing sintered porous metal plate as claimed in claim 1 wherein the metal is selected from the group consisting of ferrous metal materials and aluminum alloys.

3. A sound absorbing or vibration absorbing sintered porous metal plate as claimed in claim 2 wherein the metal is cast iron in the form of cutting chips or abatements.

4. A sound absorbing or vibration absorbing sintered porous metal plate as claimed in claim 1 wherein the plate has a porosity of about 40–60%.

* * * * *